United States Patent [19]

Duncan

[11] 4,376,441

[45] Mar. 15, 1983

[54] HAIR TREATMENT APPLICATOR

[76] Inventor: Theodore Duncan, 8400 Lindberg Blvd., Apt. 410, Philadelphia, Pa. 19153

[21] Appl. No.: 196,904

[22] Filed: Oct. 14, 1980

[51] Int. Cl.[3] ..... A45D 24/22

[52] U.S. Cl. ..... 132/9; 132/112; 401/289

[58] Field of Search ..... 132/9, 112, 113, 114, 132/118; 401/1, 2, 287, 289

[56] References Cited

U.S. PATENT DOCUMENTS

| | | | |
|---|---|---|---|
| 2,737,190 | 3/1956 | Magnusson et al. | 132/114 |
| 3,800,810 | 4/1974 | Mercer | 132/9 |
| 3,863,651 | 2/1975 | Vaiano | 132/9 |
| 3,964,501 | 6/1976 | Matchett | 132/9 X |
| 4,090,522 | 5/1978 | Donley et al. | 132/112 |
| 4,114,022 | 9/1978 | Braulke | 132/9 X |
| 4,121,602 | 10/1978 | Young | 132/113 |
| 4,209,685 | 6/1980 | Walker et al. | 132/112 |
| 4,266,116 | 5/1981 | Bauer et al. | 132/9 X |

FOREIGN PATENT DOCUMENTS

| | | | |
|---|---|---|---|
| 2328823 | 1/1975 | Fed. Rep. of Germany | 401/289 |

*Primary Examiner*—Edward M. Coven

*Attorney, Agent, or Firm*—Caesar, Rivise, Bernstein & Cohen, Ltd.

[57] ABSTRACT

An applicator for applying hair treatment preparations to a person's hair and for rinsing the preparation from the hair. The applicator is a compact device which includes a remotely located heater/blower unit coupled to a hand-held applicator assembly. The applicator assembly includes a chamber for receipt of a viscous hair treatment preparation and a plurality of apertured projections which communicate with the chamber. A stream of heated air is provided into the chamber, to melt the preparation. The melted preparation flows from the chamber, through the apertures and onto the person's hair. The projections function as comb teeth to spread the preparation through the hair. The applicator assembly can be connected to a water tap, for water to flow through the apertures of the applicator assembly so the preparation may simultaneously be rinsed and combed from a person's hair. The preferred embodiment of the invention includes a removable scoop and capsule member. The scoop is readily filled with the preparation and is inserted into the capsule. The scoop and capsule assembly is then inserted into the chamber of the applicator assembly, thus facilitating the process of filling the chamber with the preparation.

15 Claims, 5 Drawing Figures

FIG. 1
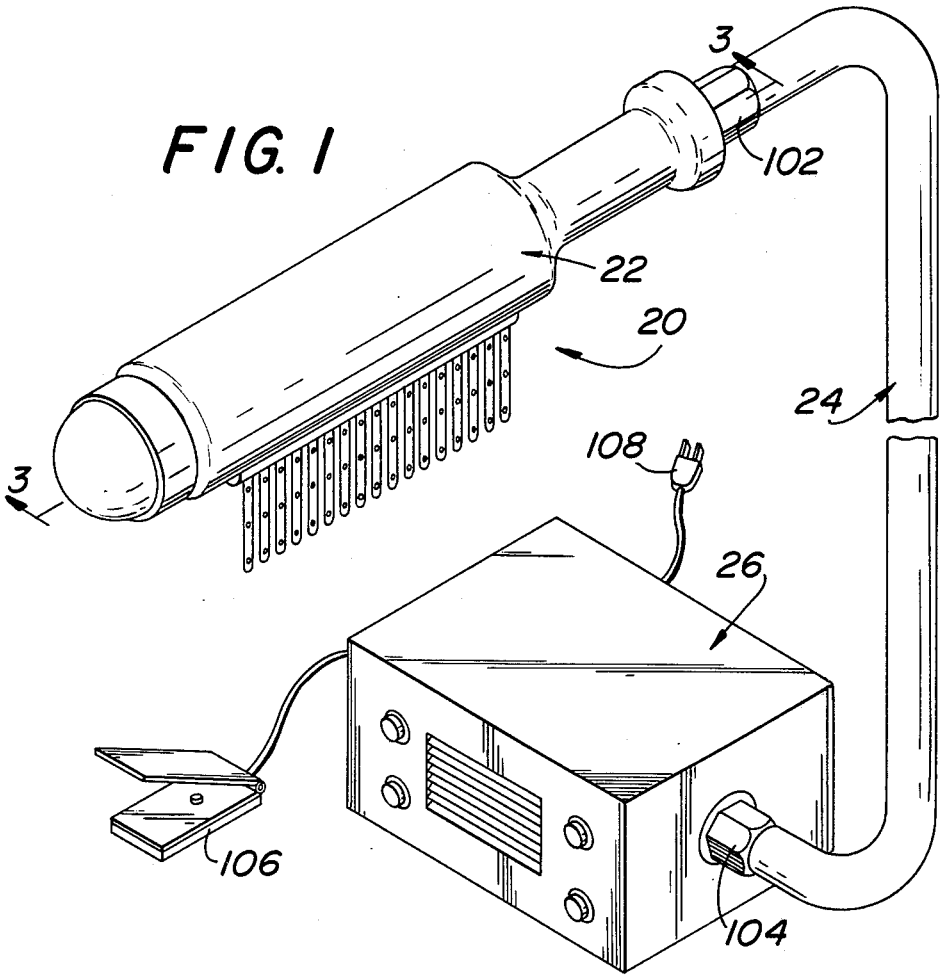
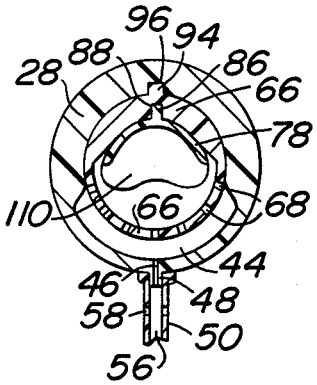
FIG. 4

HAIR TREATMENT APPLICATOR

This invention relates generally to cosmetological equipment and more particularly to means for applying hair treatment liquid preparations to the hair and for rinsing said preparations from the hair.

The application of hair treatment preparations and products, such as permanents, relaxers, etc. to the hair is normally carried out manually by cosmetologists. To that end, the existing methods of applying hair products, such as relaxers, to the hair is achieved by simply using one's hands, comb or some dipping or scooping tool to remove the product from its container and for applying it to the hair. The product is then manually massaged or combed through the hair strands.

As is known, various hair treatment preparations contain harmful surfaces which, if they come in contact with the skin or eyes can result in severe burns or other injury. Thus, there presently exists a strong need for applicators capable of handling and dispensing hair preparations safely, efficienty as well as economically.

Accordingly, it is the general object of this invention to provide a device for the application of hair treatment preparations which overcomes the disadvantages of prior art devices and techniques.

It is a further object of the instant invention to provide a device for evenly dispensing hair preparation liquids while facilitating the combing of said products through the hair strands without need for the operating personnel to come in contact with the product.

It is still a further object of the instant invention to provide a device for efficiently dispensing hair treatment preparations to reduce wasteful use thereof.

It is still a further object of the instant invention to provide a device which is simple in construction, yet suitable for professional use to provide direct dispensing of hair treatment products to the hair without the necessity for coming in contact with other parts of the body.

It is still a further object of the instant invention to provide a device for applying hair treatment products directly to the hair and for controlling the application thereof under manual control of the operator.

These and other objects of the instant invention are achieved by providing a device for applying a liquid to the hair comprising an applicator assembly and means for producing a stream of heated air and for supplying said air stream to said applicator assembly. The applicator assembly includes a handle portion and a body portion. The body portion includes a chamber for receipt of a viscous liquid therein and a plurality of teeth in the form of hollow tubular projections extending outward from the body portion. The interior of each of the teeth is in communication with the chamber and each teeth includes at least one dispensing aperture therein. The chamber is coupled to a hose connected to the means for producing the stream of heated air whereupon said heated air is provided to the chamber to cause the viscous liquid disposed therein to melt within the chamber and flow out through the chamber and out through the apertures in the teeth for direct application to the hair.

Other objects and many of the attendant advantages of the instant invention will be readily appreciated as the same becomes better understood by reference to the following detailed description when considered in connection with the accompanying drawing wherein:

FIG. 1 is a perspective view of the device of the instant invention;

FIG. 4 is a sectional view taken along line 4—4 of FIG. 3; and,

Figure 2:
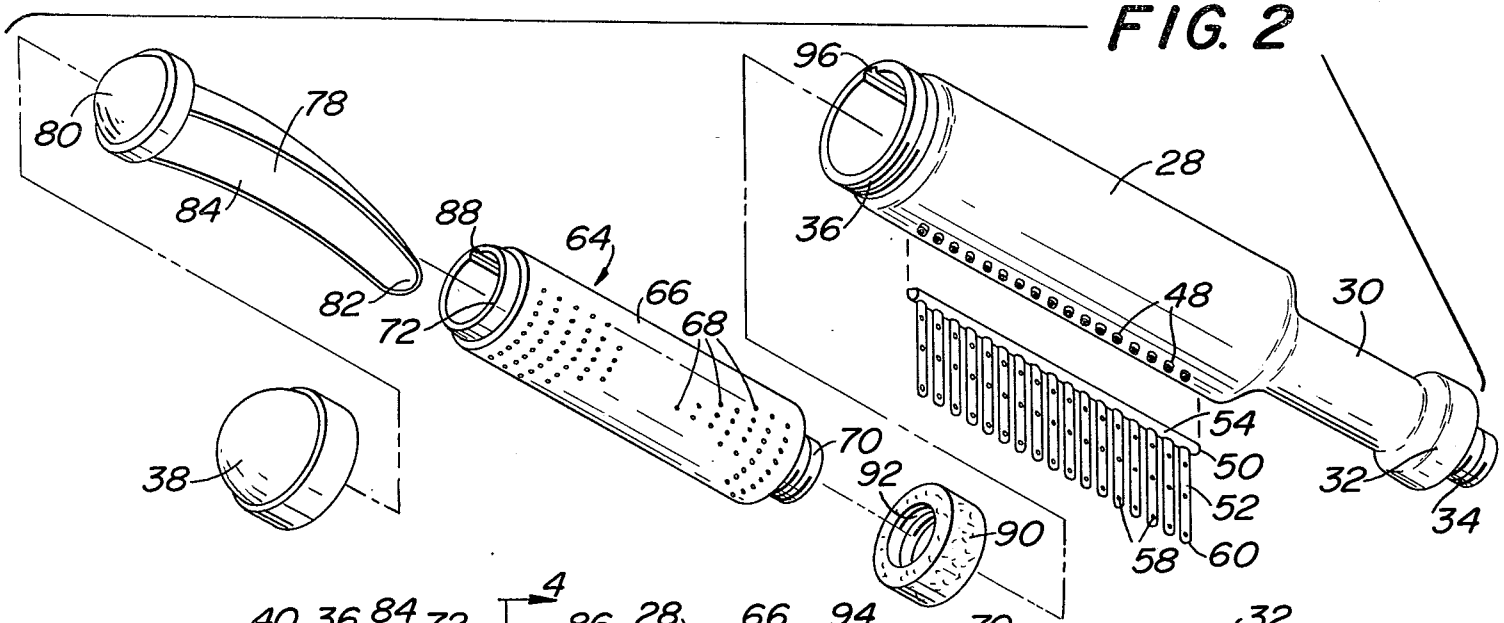
FIG. 2 is an exploded perspective view of the applicator assembly portion of the device shown in FIG. 1.

Referring now in greater detail to the various figures of the drawing wherein like reference characters refer to like parts, there is shown in FIG. 1 a device 20 constructed in accordance with the instant invention. The device 20 is arranged to receive a quanity of the viscous, hair treatment preparation, such as a creme relaxer, for dispensing directly into a person's hair without necessitating manual contact with the preparation. To that end, the device 20 basically comprises an applicator assembly 22, a hose 24 and a combined heater/blower unit 26.

The applicator assembly 22, as will be described in detail later, is an elongated member having a handle portion and including a chamber for receipt of the viscous, hair treatment preparation and includes a plurality of finger-like projections or teeth having openings in communication with the chamber. The heater/blower unit 26 is arranged to produce a stream of heated air and to provide the same via the connected hose 24 to the interior of the chamber in the applicator assembly. The heated air stream causes the hair treatment preparation to melt or decress in viscosity, whereupon it is enabled to flow out of the chamber and through the apertures in the projections for direct application to the hair of a person. Thus, the person performing the hair treatment, e.g., the cosmetologist, need not have any personal contact with the hair treatment preparation during the treatment process.

Figure 3:
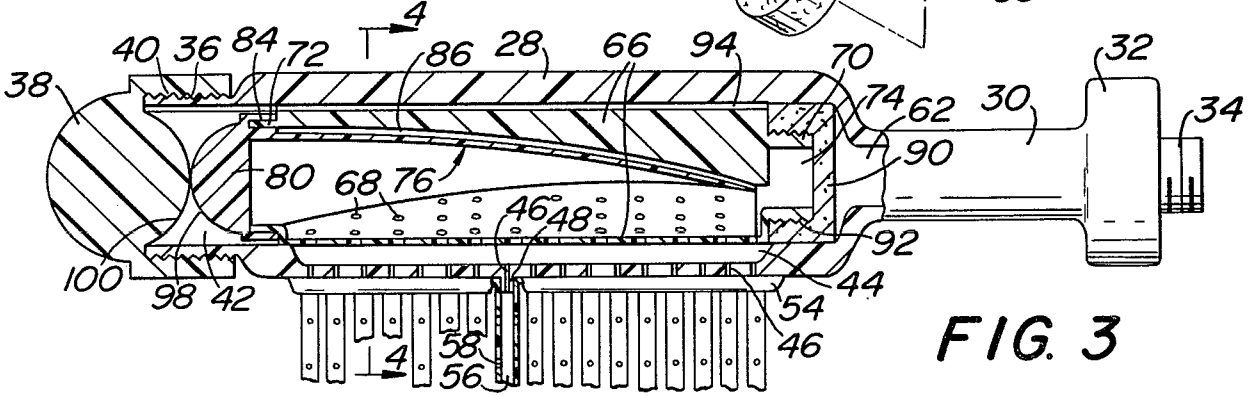
FIG. 3 is an enlarged sectional view taken along line 3—3 of the applicator assembly portion of the device shown in FIG. 1.
Figure 5:
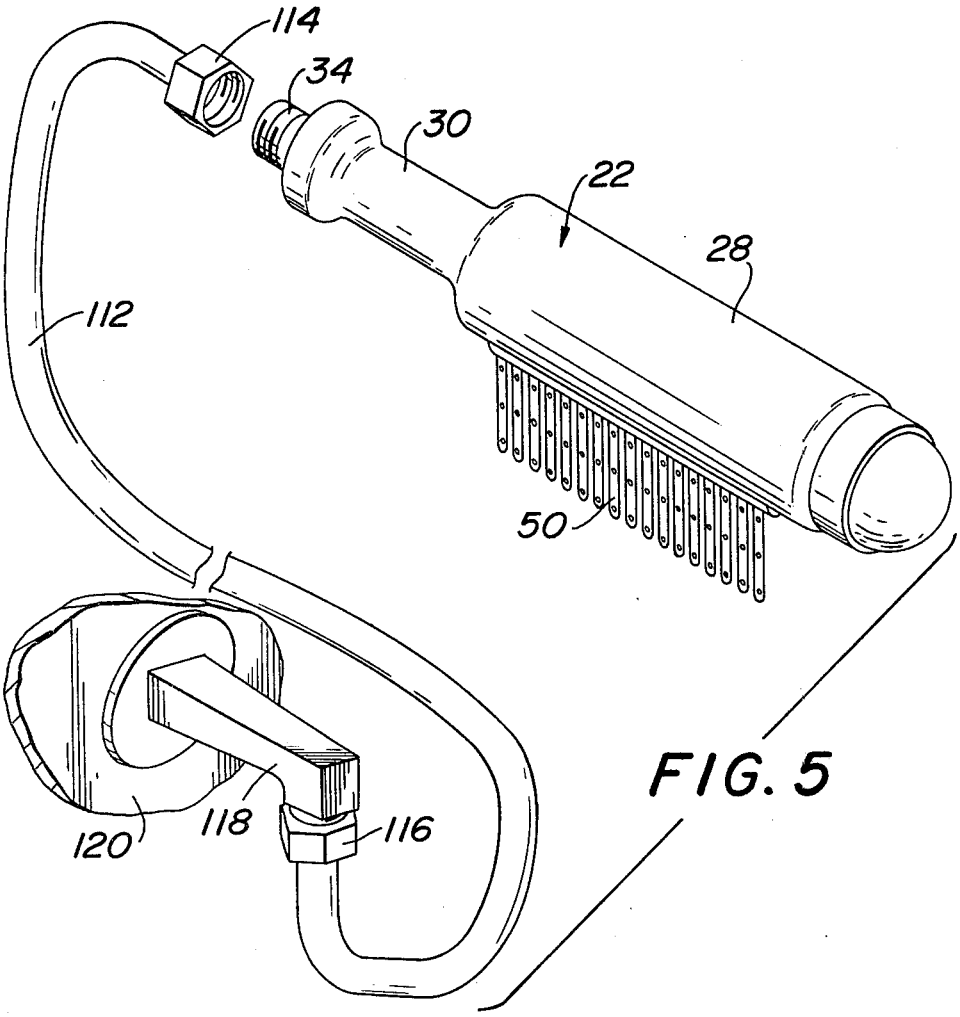
FIG. 5 is a perspective view of the applicator assembly portion of the device shown in FIG. 1 coupled to a conventional faucet.

Referring now to FIGS. 1, 2 and 3, the details of the applicator assembly 22 will be described in detail. The applicator assembly 22 basically comprises a hollow tube-like body portion 28 of generally cylindrical cross section and terminating in one end in a reduced diameter portion 30. The portion 30 serves as a hand grasp or handle. The free end of portion 30 is in the form of an enlarged annular flange 32 from which an externally threaded male coupling 34 projects. The other end of the tubular body 28 also includes an externally threaded male coupling 36. A cap 38 having a domed end is arranged to be threadedly engaged on the coupling 36 to seal the free end of the applicator's body. The interior of the tubular body 28 is in the form of a central cylindrical bore or cavity 42 from which a lobed portion 44 projects radially. The lobed portion 44 is formed by a recess or depression in the sidewall of the body portion 28. A plurality of small apertures 46 extend through the sidewall of the body portion and are in communication with the chamber portion 44. The apertures are aligned in a row along the longitudinal axis of the body portion 28. The outlet of each aperture is in the form of a small diameter, radially projecting nozzle 48 (See FIG. 2).

The assembly 22 includes a comb attachment 50 including a plurality of teeth 52, each of which is in the form of a hollow or tubular element extending perpendicularly to a base portion 54. The hollow interior 56 of each tooth 52 opens to the bottom of the base 54. The comb attachment 50 is secured to the applicator body 28 with each of the nozzles 48 located within the interior of an associated tooth 52. Accordingly, there is fluid communication between the chamber portion 44 and the interior of each tooth 52, via the communicating passageway or opening 46. Each of the teeth 52 include a plurality of ports or outlets 58 in the sidewall thereof. Each of the ports 58 is in fluid communication with the interior 56 of the tooth. The free end 60 of each tooth is rounded.

The hollow interior of the handle portion 30 is in the form of a communicating passageway 62 which is in fluid communication with the chamber 42 in the body portion 28. The outlet to the passageway 62 is provided by the coupling 34.

A capsule assembly 64, shown in FIGS. 2 and 3, is arranged to be disposed within the chamber 42 in the applicator assembly 22. The capsule assembly 64 comprises an elongated cylindrical hollow body having a sidewall 66 in which are located a plurality of small openings or pores 68. The openings 68 are confined to only a portion of the periphery of sidewall 66, e.g., an arc of approximately 90 degrees. The capsule assembly body 64 includes a pair of open ends 70 and 72. The end 70 is in the form of an externally threaded male coupling having a central passageway 74 in communication with the interior of the capsule 64. The end 72 is in the form of a reduced thickness, annular wall 72.

The thickness of the sidewall 66 of the capsule body at the location of the pores 68 is constant, whereas the thickness of the sidewall at diametrically opposed portions increases non-linearly from the end 72 toward the end 70.

The capsule assembly 64 is arranged to receive a scoop-like member 76 within its interior. The scoop-like member 76 includes a trough-shaped body 78, which tapers downward from a domed end 80 to a rounded tip 82 (See FIG. 2) and which has a longitudinally extending open mouth 84. The end 80 serves as a handle, to be described later, and includes an annular recess 84 for receipt of the annular wall 72 of the capsule body to seal the end of the capsule when the scoop is in place as shown in FIG. 3. The scoop is arranged so that when it is disposed within the capsule its open mouth 84 is located opposite the portion of the sidewall 66 containing the pores 68. To that end, the trough portion 78 includes a longitudinally extending rib or rail 86 adapted for receipt in a longitudinal extending guide slot 88. The guide slot 88 extends longitudinally along the sidewall 66 from the end 72 to the end 70 in the portion of increasing sidewall thickness.

An annular filter element 90 is disposed within the chamber 42 at the end immediately adjacent to the passageway 62. The filter element 90 includes a central threaded recess 92 for engagement with the threaded coupling end 70. The filter element 90 is formed of a material which is sufficiently porous to enable air to flow therethrough but is resistant to the flow of relatively viscous liquid, e.g., molten hair treatment fluid, therethrough.

The capsule 64 is arranged to be disposed and held within the chamber 42 so that the capsule pores 68 are in communication with the lobed chamber portion 44. To that end, the external surface of the sidewall 66 of the capsule assembly which is contiguous with the portion of increasing wall thickness includes a longitudinally extending rib or rail 94 arranged to be located within a longitudinally extending slot 96 in the inside surface of the chamber 42 disposed diametrically to the line of outlets 46.

In order to prevent the longitudinal displacement of the capsule assembly within the chamber 42 of the applicator assembly 22, the cap 80 of the capsule assembly includes an exterior domed portion 98 adapted to abut an interior domed portion 100 of the cap 38. The filter 90 and attached capsule is also held in place by the abuttment of filter 90 with the wall portion forming chamber 42 where it necks down into communication with the passageway 62.

Hot air is provided into the applicator assembly 22 via the coupling 34. To that end, the air hose 24 includes an internally threaded female coupling 102 (FIG. 1) adapted to be threadedly engaged on the mouth of coupling 34. The hose 24 is formed of any suitable flexible material, e.g., rubber, vinyl, etc., and includes at its other end second internally threaded female coupling 104. The coupling 104 is adapted to be threadedly engaged on a mating hot air outlet port of the heater/-blower unit 26.

The heater/blower unit 26 includes an electrically operated blower assembly (not shown) and electrical heating means (not shown) and can be of any suitable construction. The heater/blower unit is arranged when actuated to heat incoming air and to blow the hot air out of the outlet port and into the hose 24 for introduction within the applicator assembly 22. The unit 26 is preferably arranged to be disposed on the floor or on some other surface in the interest of safety. In order to provide operating flexibility, a manually operated foot switch 106 is connected to the electrical components within the unit 26 to energize the heater and the blower upon depression of the foot switch 106. Power is provided to the unit 26, via conventional plug 108.

Use of the device 20 is as follows: The scoop-like element 78 is grasped by holding its cap end 80 between one's fingers. The member 76 is then ready to scoop a measured amount of a viscous hair treatment preparation 110, such as a creme relaxer, from a storage vessel (not shown) such as a jar, tub, etc. Once the scoop has been filled to a desired capacity, it is inserted within the capsule 66 by aligning its guide rail 86 within the slot 88 in the wall 66 of the capsule. The scoop is then slid longitudinally fully into the capsule until the reduced thickness annular wall portion 72 of the capsule body is frictionally engaged within the annular recess 84 in the cap 80. This secures the scoop in place in the capsule and seals the end of the capsule. With the scoop thus in place in the capsule, the mass of viscous hair treatment preparation 110 is disposed immediately opposite to the pores 68 in the sidewall 66.

The filter 90 is then screwed into place on the coupling 70 of the capsule's body to complete the assembly of the capsule.

The capsule assembly 66 is then disposed within the applicator assembly chamber 42 by aligning the longitudinally extending rail 94 on the capsule's outside wall in the longitudinal extending slot 96 in the chamber. The capsule is then slid longitudinally into the chamber 42 toward the handle end 30 until the filter abuts the reduced neck portion of the body contiguous with the passageway 62. The domed cap 38 is then threadedly engaged on the male coupling 36 of the body portion 28. This action causes the interior domed-shaped portion 100 to abut the exterior domed-shaped portion of the cap 80 to hold the capsule in place longitudinally, while the guide rail and slot prevent rotation of the capsule within the chamber 42.

The device 20 is now ready for applying the hair treatment preparation 110 to the hair. To that end, the operating person grasps the applicator assembly by the handle 20 and positions it so that its comb teeth are in contact with the hair strands to be treated. The foot switch 106 is then depressed to initiate operation of the heater/blower unit 26. This action causes a hot air stream to be directed into the interior chamber 42 of the device 22, via the communicating hose 24, coupling 34 and handle passageway 62. The hot air flows through the filter 90 and through the hollow mouth 74 of the coupling 70 into the interior of the capsule 66. The hot air flowing into the capsule reduces the viscosity of the hair treatment fluid, that is causes the fluid to melt, whereupon the molten hair treatment liquid flows out through the pores 68 and into the dispensing chamber 44 therebelow. The large plurality of small diameter pores in the capsule sidewall act as a sieve to trap impurities within the capsule. From the dispensing chamber portion 44 the molten liquid is carried by the air through the communicating passageways 46 into the interior 56 of each of the combs teeth, from whence it exits through the communicating outlets 58. Thus, the operator is enabled to comb the dispensed liquid through the person's hair as the preparation is dispensed. This action insures that there is a uniform application of the preparation to the hair. Moreover the person's hair can be styled at the same time that the preparation is applied to the hair.

The device 20 of the instant invention is also arranged to effect the rinsing of a hair preparation from the hair after treatment. To that end, when it is desired to rinse the hair, the hose 24 is disconnected from the applicator assembly 22 at the coupling 34. A water hose 112, having a threaded female coupling 114 at one end thereof is secured to the coupling 34 of the applicator assembly 22. The other end of the hose 112 includes a coupling 116 for connection to a water tap 118, such as found in a sink 120. Thus, when the water tap 118 is turned on, water is enabled to flow from the tap through the communicating hose 110 and into the interior of the applicator assembly 22. The water then flows through the dispensing chamber and out through the outlets in the comb teeth. Preferably, the operator combs the person's hair while the hair treatment preparation is rinsed out of the hair by the exiting water to expedite rinsing.

As will be appreciated from the foregoing, the device of the instant invention enables any viscous-type hair preparation to be inserted within the device and converted into a liquid form so that it freely runs through the vein-like channels of the comb's teeth and out of the openings. This action has many benefits in that it enables one to apply the hair treatment preparation to desired portions of the hair in an uniform and even distribution and without requiring the operating person to touch the preparation. Moreover, the hair treatment preparation is dispensed from the device at a controlled rate, which further effectuates uniform distribution.

The use of the capsule with its associated filling scoop enables the device 20 to be filled with the hair treatment preparation quickly and easily, also without necessitating operator contact with the preparation.

Further still, the scoop, being of a predetermined capacity enables one to measure out just the desired amount of treatment preparation, thereby avoiding wastage of such products during application.

In accordance with the preferred embodiment of this invention, the applicator assembly 20 is formed of a plastic material in the interest of low cost, light weight and resistance to hazardous or corrosive hair treatment preparations. It must, of course, be noted that other materials, such as metals, can be used to form the device, if desired.

Without further elaboration, the foregoing will so fully illustrate my invention that others may, by applying current or future knowledge, readily adapt the same for use under various conditions of service.

What is claimed as the invention is:

1. A compact device for applying a hair treatment preparation liquid to hair comprising an applicator assembly and remotely located means for producing a stream of heated air and for supplying said air stream through flexible conduit means to said applicator assembly, said applicator assembly being readily manipulatable and comprising a hand grasping portion and a body portion, said body portion including a dispensing chamber, said dispensing chamber including an access port, replaceable capsule means and filter means, said access port enabling the insertion and removal, respectively of said capsule means from said chamber, said capsule means being hollow for receipt of a mass of viscous hair treatment liquid preparation and having at least one dispensing aperture and an inlet opening communicating with the interior of said capsule means, said filter means being coupled between said inlet opening and said conduit means for allowing said heated air to pass therethrough while precluding said preparation liquid from passing therethrough, said body portion also comprising a plurality of teeth in the form of hollow tubular projections extending outward from said body portion, the interior of each of said teeth being in communication with the interior of said capsule means and each of said teeth including at least one dispensing aperture, said dispensing chamber receiving said heated air stream from said conduit means whereupon said heated air passes through said filter means, into said capsule means to cause said viscous liquid to melt within said capsule means and to flow thereout through the dispensing apertures in said teeth for application to hair.

2. The device of claim 1 wherein said capsule means has a large plurality of dispensing apertures.

3. The device of claim 2 wherein said body portion is an elongated tubular member whose interior forms said dispensing chamber and wherein said teeth are disposed longitudinally along said body portion to form a comb-like structure.

4. The device of claim 3 wherein said body portion includes a releasably securable cap disposed over said access port, said capsule being of a suitable size to fit through said access port for disposition within said chamber.

5. The device of claim 4, further comprising scoop means arranged to scoop a mass of said viscious liquid from a source of supply thereof and for insertion and securement within said capsule, wherein said apertures in said capsule are located closely adjacent to the hollow interior of said teeth and wherein said scoop means includes guide means for facilitating the insertion of said scoop means in said capsule.

6. The device of claim 5 wherein said capsule includes guide means for insuring that the apertures in said capsule remain located closely adjacent to the hollow interior of said teeth.

7. The device of claim 6, further comprising a longitudinally extending slot in said body portion wherein said capsule guide means comprise a guide rail extending longitudinally along said capsule for location within said slot.

8. The device of claim 5 wherein said guide means comprises a longitudinally extending guide rail and wherein said capsule includes a longitudinally extending slot for receipt of said guide rail.

9. The device of claim 1 wherein said capsule means additionally comprises scoop means arranged to scoop a mass of said viscous liquid from a source of supply thereof and for insertion and securement within said capsule.

10. The device of claim 1 wherein said means for producing said heated air stream comprises an electrically operated heater and blower assembly.

11. The device of claim 10 wherein said heater and blower assembly is arranged for disposition on a supporting surface.

12. The device of claim 11 additionally comprising a manually operable switch for controlling the operation of said heater and blower assembly.

13. The device of claim 12 wherein said switch is a foot switch.

14. The device of claim 1 additionally comprising a second flexible hose for releasable securement to said body portion and to a source of rinsing fluid.

15. The device of claim 1 wherein said second flexible hose comprises a coupling for securement to a water tap as the source of rinsing fluid.

* * * * *